US005669581A

United States Patent [19]

Ringer

[11] Patent Number: 5,669,581

[45] Date of Patent: Sep. 23, 1997

[54] SPIN-STABILIZED GUIDED PROJECTILE

[75] Inventor: Hayden N. Ringer, Laguna Hills, Calif.

[73] Assignee: Aerojet-General Corporation, Ohio

[21] Appl. No.: 560,132

[22] Filed: Nov. 17, 1995

Related U.S. Application Data

[63] Continuation of Ser. No. 225,634, Apr. 11, 1994.

[51] Int. Cl.[6] ..... F41G 7/22

[52] U.S. Cl. ..... 244/3.16

[58] Field of Search ..... 244/3.22, 3.16, 244/3.23, 3.15; 102/384, 213, 492; 342/62

[56] References Cited

U.S. PATENT DOCUMENTS

| | | | |
|---|---|---|---|
| Re. 26,887 | 5/1970 | McLean . | |
| 2,873,381 | 2/1959 | Lauroesch . | |
| 3,843,076 | 10/1974 | King et al. | 244/3.16 |
| 3,942,446 | 3/1976 | Cruzan | 102/70.2 |
| 4,037,806 | 7/1977 | Hirsch et al. . | |
| 4,098,191 | 7/1978 | Bagwell et al. | 102/213 |
| 4,142,696 | 3/1979 | Nottingham . | |
| 4,193,688 | 3/1980 | Watkins . | |
| 4,245,559 | 1/1981 | Wakeman et al. | 102/213 |
| 4,245,560 | 1/1981 | Rambauske | 102/213 |
| 4,537,370 | 8/1985 | Pizzurro | 244/3.16 |
| 4,560,120 | 12/1985 | Crawford et al. | 244/3.22 |
| 4,627,351 | 12/1986 | Thordarson et al. | 102/213 |
| 4,690,351 | 9/1987 | Beckerleg et al. | 244/3.16 |
| 4,717,822 | 1/1988 | Byren . | |
| 4,728,057 | 3/1988 | Dunne . | |
| 5,018,447 | 5/1991 | Miller, Jr. et al. | 102/213 |
| 5,054,712 | 10/1991 | Bar et al. | 244/3.22 |
| 5,077,465 | 12/1991 | Wagner et al. . | |
| 5,082,201 | 1/1992 | Le Bars et al. . | |
| 5,088,659 | 2/1992 | Neff et al. . | |
| 5,127,604 | 7/1992 | Klaus, Jr. et al. | 244/3.16 |
| 5,142,150 | 8/1992 | Sparvieri et al. . | |
| 5,261,629 | 11/1993 | Becker et al. | 244/3.22 |
| 5,333,815 | 8/1994 | Sardanowsky | 244/3.16 |
| 5,529,262 | 6/1996 | Horwath | 244/3.16 |

*Primary Examiner*—Michael J. Carone
*Assistant Examiner*—Christopher K. Montgomery
*Attorney, Agent, or Firm*—Leonard Tachner

[57] ABSTRACT

A spin-stabilized projectile for destroying distant targets uses the projectile's spin to carry out other functions such as target imaging, course-correction and warhead aiming. By using the spin to carry out such functions, in addition to stabilization, the projectile can be implemented with fewer or no moving parts. The projectile may utilize either right or skewed-core fusing for the warhead.

6 Claims, 5 Drawing Sheets

SPIN-STABILIZED GUIDED PROJECTILE

This is a continuation of copending application Ser. No. 08/225,634 filed on Apr. 11, 1994.

BACKGROUND OF THE INVENTION

1. Field of the Invention

The present invention relates generally to the field of smart munitions, and more specifically to a spin-stabilized guided projectile in which all the subsystems use the roll or spin of the projectile as a prime mover, so that the projectile itself has no moving parts. Accordingly, this invention is based on using the spin of a spin-stabilized ballistic projectile to enhance or enable all of the required functions of a guided projectile to achieve a smart munition, fully-capable against a large variety of air (and surface) targets. Using roll or spin as the prime mover, all subsystems can be made fixed body and thus complex and costly mechanisms are replaced with low-cost and reliable pyrotechnics and battery-operated electronics.

2. Prior Art

The present invention is not the first to use roll or spin of a projectile for carrying out some functions of the projectile flight and intercept. However, in the past, roll or spin of the projectile has been used for only limited purposes, usually enhancing some functions to the detriment of others. In most cases, the spin of the projectile is used primarily as a stabilizing function. However, none of the prior art, known to the Applicant, utilizes the spin of the projectile for all of the different functions of the munition operation, such as detection of targets, course-correction, fuzing and warhead mode selection, resulting in very low relative cost and high-reliability by minimizing or entirely obviating moving parts required in the prior art. The search of the prior art has turned up the following patents:

| | |
|---|---|
| RE 26,887 | McLean |
| 2,873,381 | Lauroesch |
| 4,037,806 | Hirsch et al |
| 4,142,696 | Nottingham |
| 4,193,688 | Watkins |
| 4,717,822 | Byren |
| 4,728,057 | Dunne |
| 5,077,465 | Wagner et al |
| 5,082,201 | Le Bars et al |
| 5,088,659 | Neff et al |
| 5,142,150 | Sparvieri et al |

U.S. Pat. No. 5,088,659 to Neff et al is directed to a projectile equipped with an infrared search system at its bow. Thus, the target area can be scanned and corrections made to the flight course of the projectile. Referring to FIG. 1, one sees a spin-stabilized projectile 10 which rotates about longitudinal axis 10'. Projectile 10 has a dome 11 which is transparent to infrared radiation at its front end. Within projectile 10, there is disposed a laser transmitting and scanning module 12 and a receiving module 13 with electronic evaluation system 14, as well as a roll rate sensor 15. Using this system, a target is imaged and the necessary corrections to the missile trajectory are made in order to be directed to the target of interest.

U.S. Pat. No. 4,193,688 to Watkins is directed to an optical scanning system wherein IR radiation is directed to a system that is rotated about the boresight axis of the scanning system. Linear array infrared detector elements are disposed in the image plane radially from the boresight axis of the scanning system. As seen in FIG. 1, guided missile 8 carries a scanning system 11 that responds to energy radiated from target 10, such energy entering the frontal portion of missile 8. Scanning system 11 includes a Porro prism for rotation about boresight axis 12 of detector elements 20, 21, 22, and 23. Such detector elements are responsive to focused infrared energy entering the frontal portion of missile 8 received from the target object 10. FIGS. 4 and 5 provide some insight to the optical scanner and the related detector elements.

U.S. Pat. No. 4,037,806 to Kirsch et al is directed to a control system for a rolling missile with target seeker head. Diagrammatically, FIG. 1 shows missile 10 with infrared-tracking seeker section 11 which is of interest. Seeker section 11 contains a gyro-stabilized seeker head assembly to track the target and to provide an output signal proportional to the rate of change of the line-of-sight to the target.

U.S. Pat. No. 2,873,381 to Lauroesch is directed to a rotary scanning device which is used in target detection systems for control of guided missiles. Referring to the Figures, missile head 1 carries a pair of reflectors 11 and 12 spaced radially from axis 6. These reflectors reflect rays of radiant energy designated by dash lines 13 and 14 to impinge upon reflector 11 toward detectors 9 and 10. The information obtained by the scanner can thus be converted into information that permits accurate location of the object relative to the craft carrying the scanner.

U.S. Pat. No. 5,082,201 to Le Bars et al is directed to a missile homing device which is used to obtain information about the angular deviation between the direction in which a missile is located and a line-of-sight in which the target is located. The invention includes a means to project and shift an image so as to analyze it by means of a sensor 11. The image of the field is scanned circularly by sensor 11 which is an alignment of photo-sensitive cells with an axis AC through the center of the image. Sensor 11 is then able to analyze a ring of the image and the information is then processed in order to provide guidance for the missile trajectory.

U.S. Pat. No. 5,077,465 to Wagner et al is directed to a gyro-stabilized seeker which is used to guide a missile to a target. Detector means 130 is formed by a linear arrangement of detector elements.

None of the prior art known to the applicant, including the aforementioned U.S. Patents discloses a system which utilizes the spin of a spin-stabilized ballistic projectile to enable or enhance all of the required functions of a guided projectile to achieve a smart munition fully-capable against a large variety of air and surface targets. Those functions include, in addition to stabilizing the projectile, the functions of seeker, navigation and diversion, fuze control and warhead control.

SUMMARY OF THE INVENTION

In a preferred embodiment, the present invention comprises a low drag, medium caliber projectile, spinning at several hundred revolutions per second, while traveling at several thousand feet per second. The effective use of projectiles against high-speed maneuverable air-targets requires the employment of a high-performance fire control system which can almost perfectly predict some future position of the target and get a near-ballistic projectile to that future position at the right time to deploy a war head for destruction of the target. Neglecting drag/slow down, gravity and target maneuvers for the moment, the unguided projectile will fly a straight-line constant-bearing collision course with the target at predictable, constant off-axis bearing and roll angles. By using fire control information, target search can be concentrated in a predicted sector, and detection range increased or seeker size and cost reduced.

The present invention utilizes the spinning rotation of the projectile to provide an imaging-infrared seeker-fuze operation. Spinning motion rotates a linear array of infrared detectors, causing them to scan concentric circles about the projectile axis by means of a forward-looking lens. These circles, in combination, image a large part of the projectile's forward hemisphere with a frame rate which is equal to the spin rate of the projectile. Another function of the spin capability of the projectile of the present invention is course-correction and diversionary tactics. Because of gun, projectile and fire control tolerances, atmospheric conditions and target jinking, the target will generally first appear off of the predicted long-range line-of-sight and will generally appear to move further over time. With the measurement of a target's line-of-sight motion vector and an impulse correction system, the goal is to apply enough correction to the projectile motion to achieve and maintain a constant line-of-sight to intercept. An impulse correction is applied normal to the long axis of the projectile, through the center of gravity in the same direction as the line-of-sight drift, achieved by firing an impulse when the projectile is in a selected roll position. A control algorithm becomes similar to that of a skewed-cone fuze (see below). Thus, the present invention makes use of the projectile's high spin rate to permit impulse corrections to zero the line-of-sight rate and result in a collision between the projectile and the target.

The present invention does not require the use of a separate fuze subsystem. Fuzing is accomplished by means of the seeker. Fuzing may be regarded as the last of a series of course-corrections, beginning with gun aiming. The gun is aimed to a predicted future position of the target when intercept will occur. Similarly, one or more explosive impulse diversionary tactics are aimed to result in future intercepts. If because of errors a miss appears inevitable in the final instants of the end game, the fuze triggers the planar warhead to explosively divert high-velocity war head fragments at the target. With a seeker-fuze capable of accurately predicting miss timing and miss azimuth about the warhead roll axis, it is possible to concentrate the fragment spray in azimuth as well, thus producing a focused mass warhead. On the other hand, for very close misses, it may be desirable to have an alternate central detonator to create a more nearly omnidirectional blast-fragment pattern.

The present invention also contemplates an embodiment which would have applications of an air-target-guided projectile against surface targets. Thus, it will be seen hereinafter that the present invention comprises a spin-stabilized guided projectile, using roll to advantage in every subsystem, namely using roll to provide a stable accurate flight along a minimum-energy ballistic intercept path with lock-on after launch; using roll to generate and stabilize imagery used in many ways; using roll to vector just-in-time short-range course-corrections; and using roll to vector the lethal-at-a-distance focused warhead fragments.

OBJECTS OF THE INVENTION

It is therefore a principal object of the present invention to provide a spin-stabilized ballistic projectile, while using the high spin rate of the projectile to perform a number of target intercept and destruction functions, including infrared imaging, short-range course-corrections and for employing focused warhead fragments for increasing lethality at-a-distance.

It is an additional object of the present invention to provide a spin-stabilized ballistic projectile, using roll of the projectile as a prime mover in every subsystem without moving parts, thus, resulting in a relatively low-cost and highly reliable target intercept projectile.

It is still an additional object of the present invention to provide a target intercept ballistic projectile which uses the spin or roll of the projectile to enable or enhance all of the required functions of the guided projectile to achieve a smart munition, fully-capable against a large variety of air and surface targets wherein complex and costly mechanisms of the prior art are replaced with low-cost, reliable pyrotechnics and battery powered electronics.

BRIEF DESCRIPTION OF THE DRAWINGS

The aforementioned objects and advantages of the present invention, as well as additional objects and advantages thereof, will be more fully understood hereinafter in conjunction with the following drawings in which:

FIG. 1, comprising

DETAILED DESCRIPTION OF A PREFERRED EMBODIMENT

Figure 1A:
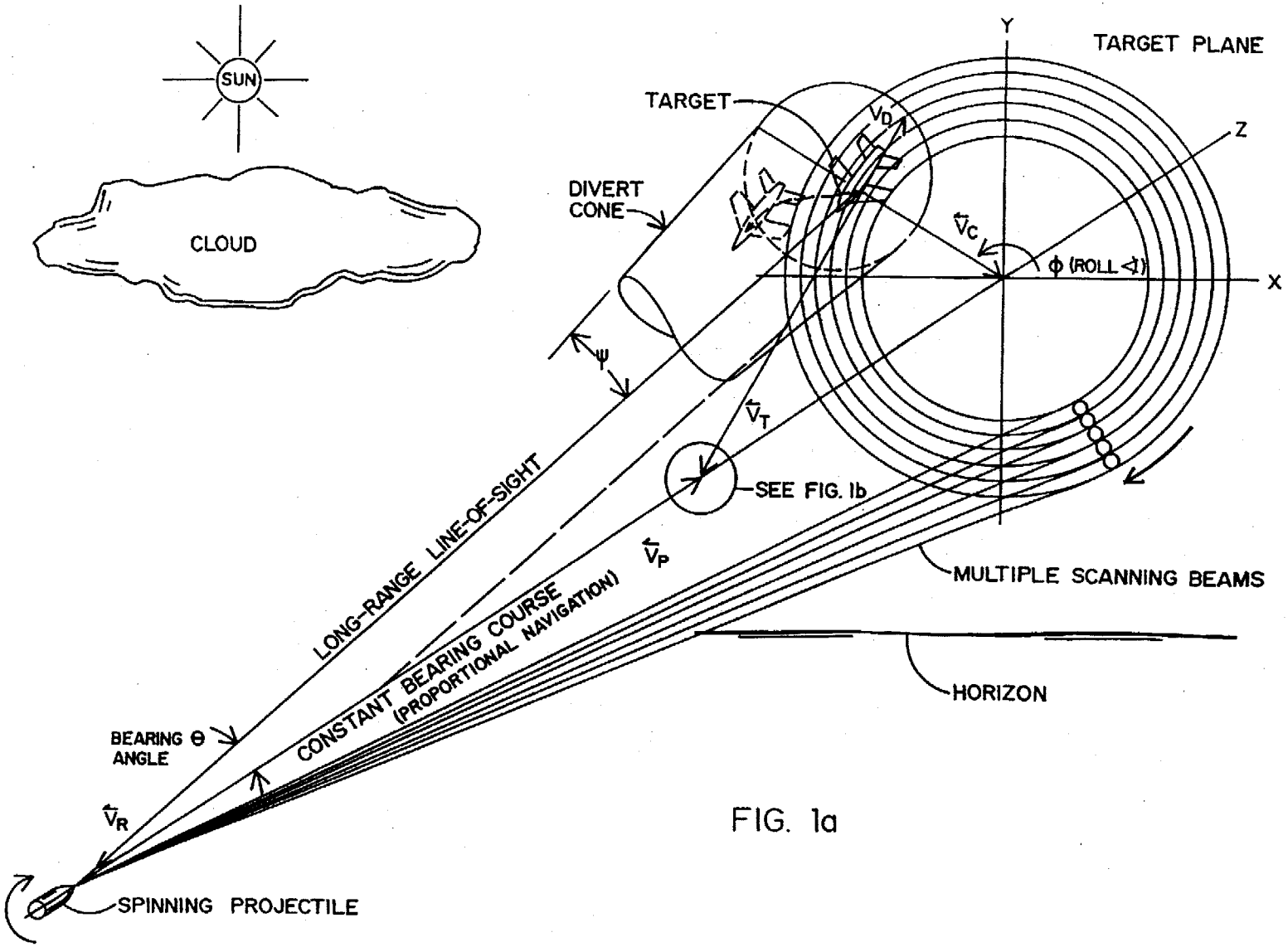
FIGS. 1*a* and 1*b*, is a diagram of air-target intercept geometry, using the spin-stabilized projectile of the present invention.

The effective use of projectiles against high-speed maneuverable air-targets requires the employment of a high-performance fire control system which can almost perfectly predict some future position of a target and get a near-ballistic projectile there at the right time. Neglecting drag/slow down, gravity and target maneuvers for the moment, the unguided projectile will fly a straight-line, constant-bearing collision course with the target at predictable, constant off-axis bearing and roll angles (See FIG. 1*a* and FIG. 1*b*). By using fire control information, target search can be concentrated in this predicted sector and detection range increased or seeker size and cost reduced. TABLE I provides a definition of the parameter designations used in FIG. 1*a* and FIG. 1*b*.

TABLE I

| PARAMETER DEFINITIONS |
|---|
| $\nabla_P$ = Vector Projectile Velocity |
| $\nabla_T$ = Vector Target Velocity |
| $\nabla_R$ = Vector Relative Velocity = $\nabla_T - \nabla_P$ |
| $\nabla_C$ = Vector Crossing Velocity |
| $\theta$ = Bearing Angle $\doteq \tan^{-1} V_C/V_R$ |
| $V_D$ = Divert Velocity (plane parallel to X-Y) |
| $\psi$ = Divert Half-Cone Angle $\doteq \tan^{-1} V_D/V_R$ |
| $V_W$ = Warhead Velocity (plane parallel to X-Y) |
| $\not\equiv$ = Fuze Half-Cone Angle $\doteq \tan^{-1} V_W/V_R$ |

The spinning motion of the projectile of the present invention rotates a linear array of filtered infrared detectors, causing them via a forward-looking lens to scan concentric circles about the projectile axis. These circles combine to image a large part of the projectile's forward hemisphere with a frame rate that is equal to the projectile's spin rate. Individual and consecutive images can be processed to provide many types of information. Such information includes housekeeping, including the roll rate, horizontal and/or vertical reference and yaw and pitch detection. The information also includes image stabilization, search, detection and track-while-scanning of one or more airborne infrared targets. It also provides means for selection of a desired target and approach, and rejection of countermeasures. Such information also provides angle motion detection of the desired target and required course-correction vectoring for intercept. It also provides passive range by the rate of growth of both target signal intensity and image size and stadiometry. In addition, such information permits angle-only seeker-fuzing with aim-point selection and directional warhead vectoring.

As a practical matter, because the closing target appears to veer off rapidly, if and as a miss develops, blooming rapidly in both signal and intensity and image size, the linear array can be tapered to relax sensitivity (detector, cooling) and resolution off the long-range line-of-sight (LRLOS).

For head-on, high-speed or slow aircraft targets or surface targets, the LRLOS is essentially aligned with the projectile spin axis, except for the known curving ballistic trajectory. For high-speed crossing targets, however, the LRLOS may be a radian or more off the projectile nose, requiring that the array and any optics, or at least the high-resolution portion of the optics, be slowly trainable along the anticipated LRLOS if such targets are contemplated.

COURSE-CORRECTION/DIVERT

Figure 1B:
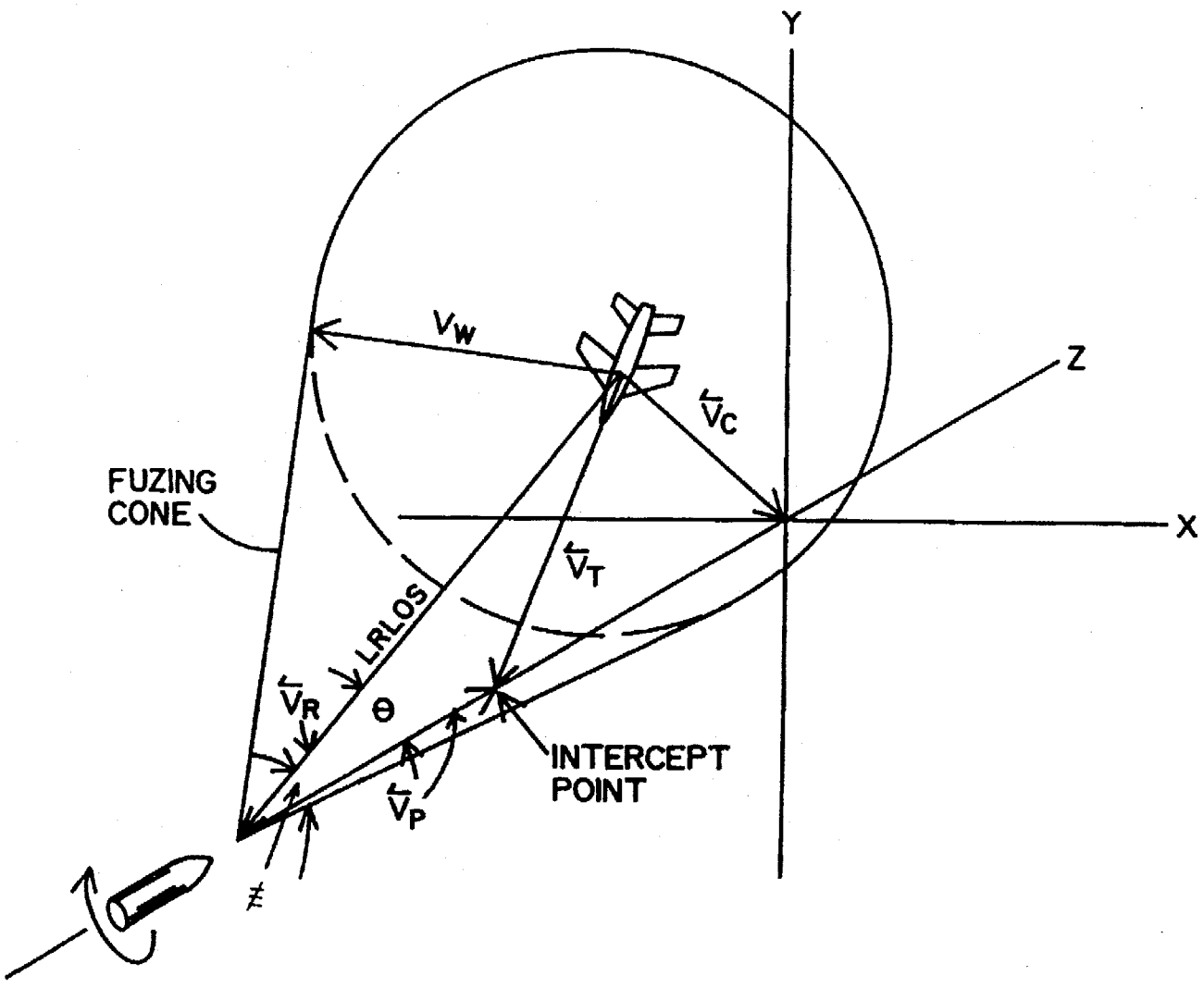

Because of gun, projectile and fire control tolerances/roundoff, atmospheric conditions and the curved ballistic trajectory, as well as target jinking, the target will generally first appear off the predicted LRLOS and will generally appear to move further over time (See FIG. 1*a*). While this motion will be essentially linear over the short time required or available to observe and correct for it, it may be complicated by non-linear ballistics (slow down, gravity drop, precession) or target maneuvers. Slow down and gravity drop/parabolic trajectory may be computed out using pitch or fire control information and a vertical roll reference, such as obtained from a horizon sensor (a beam like the seeker beam). If gravity drop is no problem, an arbitrary roll reference/spin rate sensor, such as a spinning loop magnetometer, will do to track the target in roll. Precession can be largely designed out, but can be processed out if necessary, by using image stabilization or a low-cost rate gyro reference. Targets are unlikely to jink or jink effectively in this short sensing/correction time.

Given a measurement of the target's line-of-sight (LOS) motion vector, with a continuous correction system, the game is to apply enough correction to the projectile motion to achieve and maintain a constant LOS to intercept. With an impulse correction (applied normal to the long axis of the projectile through the center of gravity in the same direction as the LOS drift, by firing the impulse in that roll position) the control algorithm becomes similar to that of a skewed-cone fuze. When the target cuts the skewed-cone, established by the closing and impulse velocities, applying the impulsive correction velocity $\overline{V}_D$ in the LOS drift direction will zero the LOS rate and result in a collision. Several practical items regarding this form of divert are worth noting. For example, as compared with aerodynamic diverts which behave as $KT^2$, explosive divert behaves as MT. For typical K's and M's, $KT^2<MT$ for $T<1$ second, which means a quicker response to final course-corrections and smaller misses. In addition, pyrotechnics can be used to damp out wobbulations induced by the explosive correction. Furthermore, range decreases with successive diverts, so that angular tolerance can be opened up with wobbulation. Finally, a minimum-drag penalty is incurred and longer effective range is achieved.

FUZING

Note, that in concept, there is no separate fuze subsystem. There is only fuzing by means of the seeker. The integral seeker-fuze tracks the target continuously from detection to detonation, predicting future positions with the same algorithms. Fuzing may be regarded as the last of a series of course-corrections, beginning with gun aiming. The gun is not aimed to have the projectile intercept the existing target position, but rather its predicted future position when intercept incurs. Similarly, one or more explosive diverts are aimed to result in future intercepts. If because of errors, a miss appears inevitable in the final instants, the fuze triggers the warhead to explosively divert high-velocity warhead fragments, instead of the entire projectile, at the predicted target position.

Figure 2:
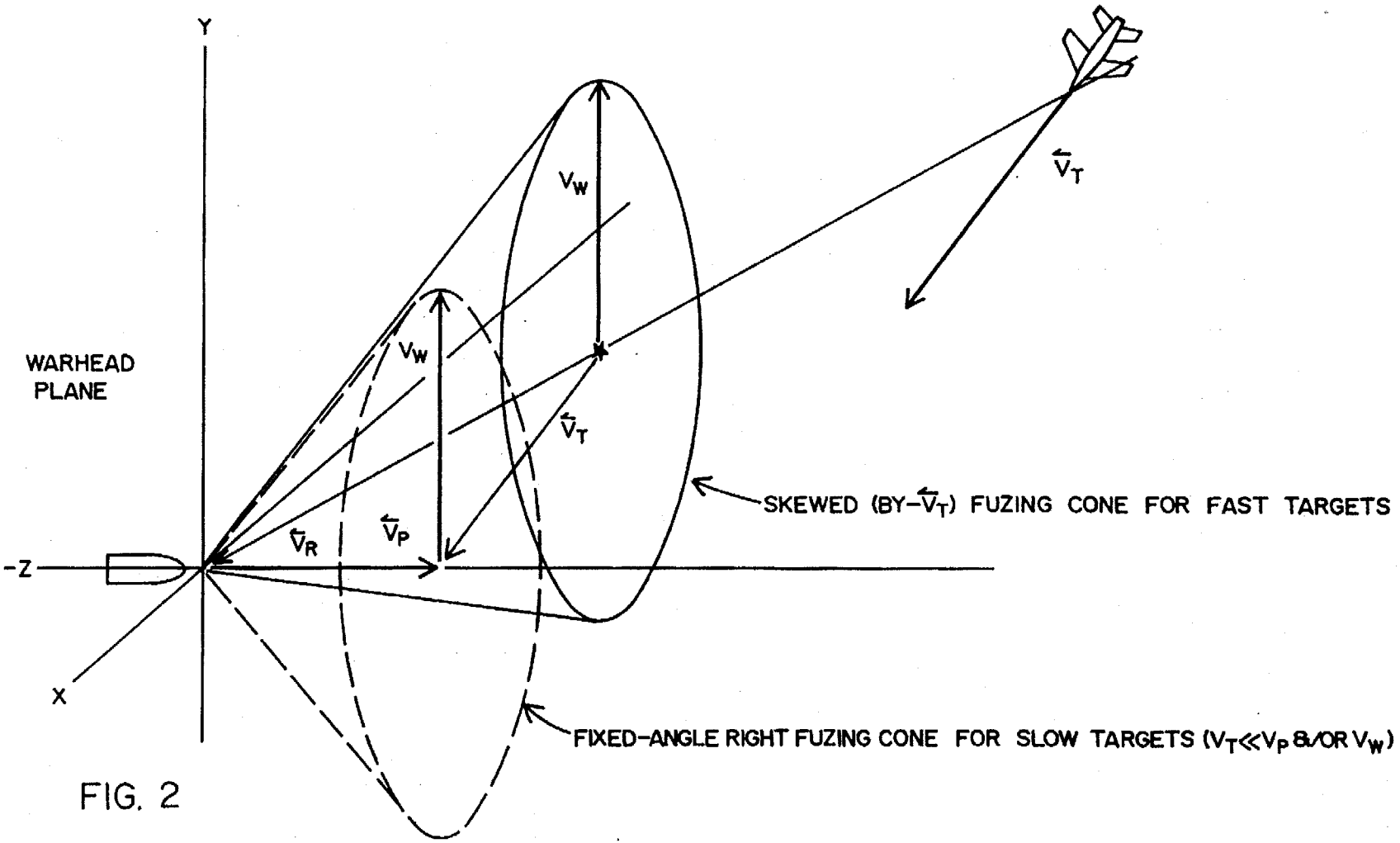
FIG. 2 is a diagram of right and skewed-cone fuzing employed in the invention.

Shortly after World War II, it was realized that a missile, rocket or projectile fuze whose sensing/triggering surface was tilted forward in a cone about the projectile axis, with a half cone angle equal to the arc tangent of the warhead velocity divided by the projectile velocity, would result in hits on a slow target if a planar warhead, normal to the projectile velocity, was fired when the target penetrated the fuzing cone. In other words, it takes as long for the target to reach the fragment impact point from the fuzing point, traveling at a relative velocity $V_R$, approximately equal to $V_P$, as it takes the lethal agent, traveling at $V_W$, independent of miss distance. With high-speed targets (having a $V_T$ on the same order as $V_P$ and/or $V_W$), the fuze cone must be skewed by $-\overline{V}_T$, as shown herein in FIG. 1*b* and FIG. 2, approximated here by a multiplicity of elements of right cones generated by the scanning beams. Because the spinning beams provide the direction of the miss, a planar warhead can be concentrated in the roll plane for increased lethality.

Note that angular perturbations from the divert impulse do not affect fuzing because the fuze and warhead beams are locked together and the perturbations are only a few degrees or less, out of typically tens of degrees of fuzing action. Note also that by using the spinning detectors to generate target images, warhead aim-point selection may be achieved to increase lethality. In conclusion, note that even should the seeker fail, or fail to acquire, the system performance degrades gracefully to that of an unguided projectile with a skewed-cone fuze.

WARHEAD

Early air-target warheads were nearly omnidirectional blast-fragment types. As fuzing accuracy improved, it was possible to concentrate the fragment spray into almost a planar type, normal to the missile axis, and thereby achieve greater lethality or good lethality at larger miss distances. With a seeker-fuze capable of accurately predicting miss direction in azimuth about the warhead roll axis, it is possible to concentrate the fragment spray in azimuth as well (mass-focused), not all in a single beam, but two, three or four beams. One of these spinning beams is focused on the target several times during a typical encounter, so it is possible to fuze on the most lethal sweep: a quantized aim-point selection. For very close misses, it may be desirable to have an alternative detonator to create a more nearly omnidirectional blast-fragment pattern. In all cases, pyrophoric enhancement is desirable, particularly with surface targets to be discussed below.

VARIATIONS

Figure 3:
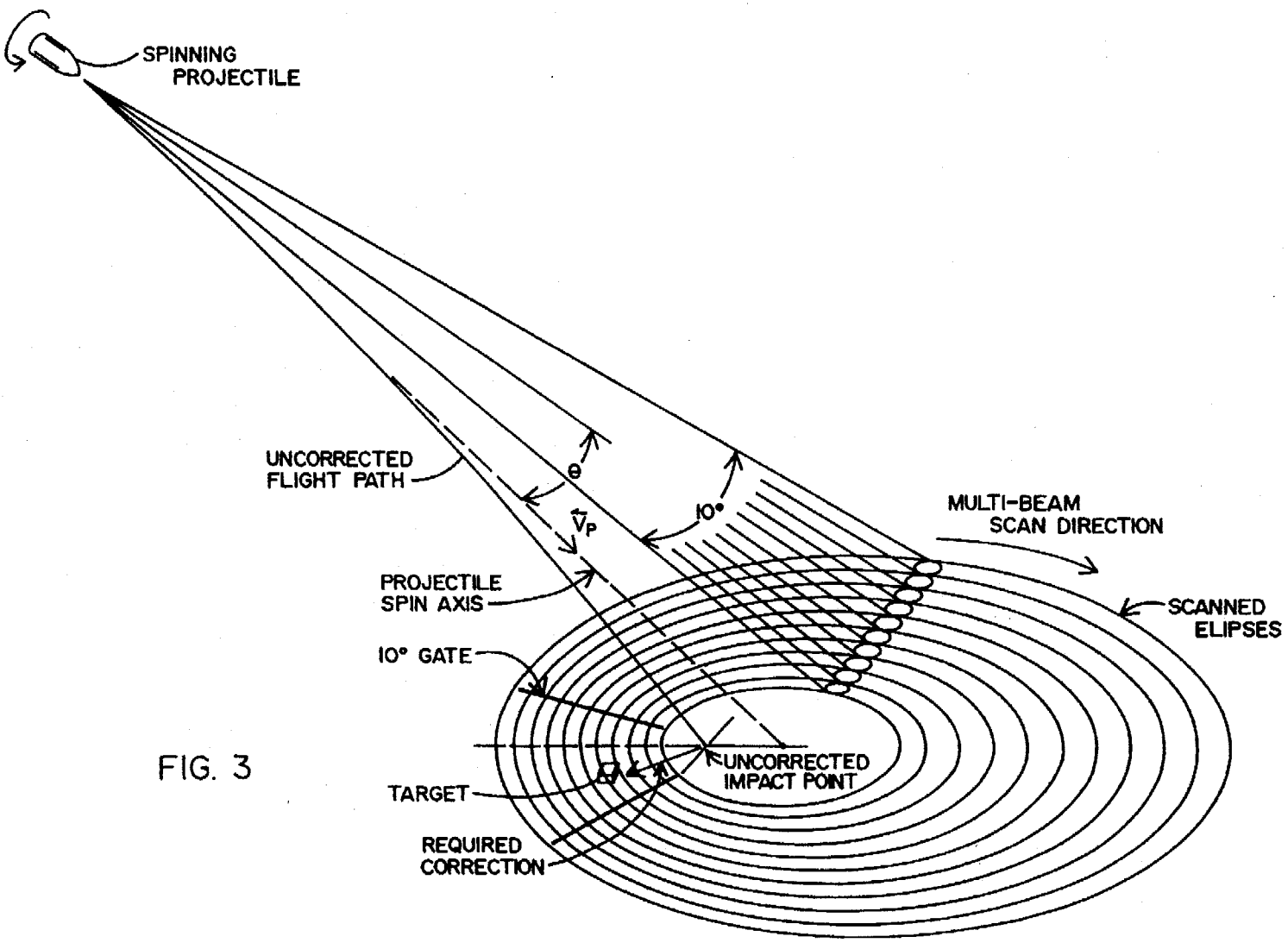
FIG. 3 is a diagram of surface-target scan geometry used in the invention.
Figure 4:
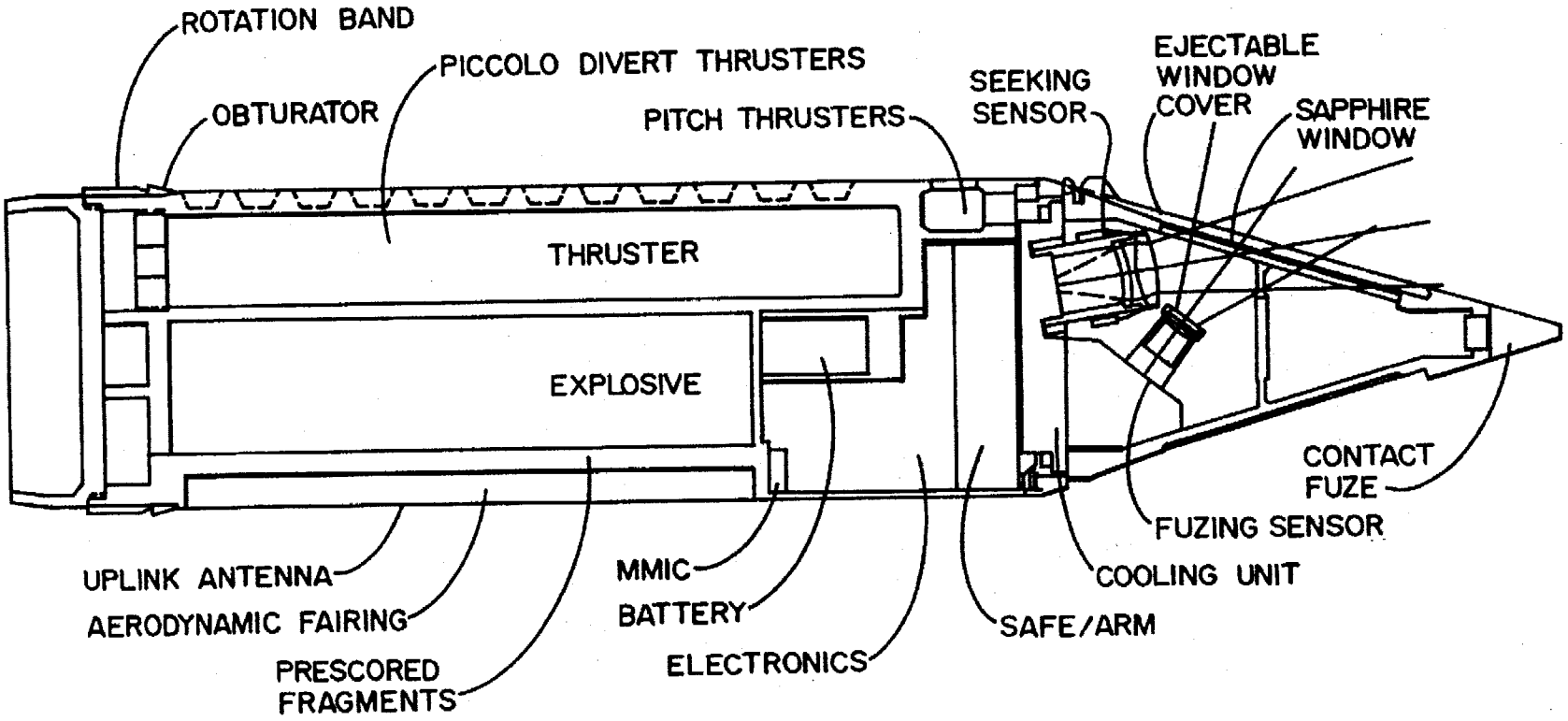
FIG. 4 is a simplified diagram of the projectile of the invention.

The above discussion concerns the application of rolled subsystems in an air-target-guided projectile. An identical guided projectile can be used also against a variety of surface targets, perhaps not quite optimally, but certainly cost-effectively, in regard to development and production cost, logistics and multi-mission capability. The same $I^2R$ seeker-fuze can obviously be used against IR surface targets (SEE FIG. 3), thus permitting all of the above seeker-fuze functions, in addition to moving target indication, map matching versus fixed targets and known mobile target areas, fuze mode selection from proximity, stand-off, contact, and delay and warhead mode selection from directional mass-focus, blast-fragment and HEP.

Of course, different fuzing and warhead modes should be used against particular types of surface targets. Because of the absence or reduction in surface target speeds, many shots will result in hits. Optimum modes include blast-fragment with contact-plus-delay fuzing for light buildings, trailers and vans, air-burst blast-fragment for area targets such as dumps and personnel, and rear-end-detonated HEP mode on contact for hard points such as ships and heavy vehicles. The optimum modes can be designated by the initializer (see below), or in most cases, deduced by the $I^2R$ seeker-fuze. The proximity fuzed mass-focus mode is a backup for near misses.

All of the above are possible without change to the air-target projectile and without much, if any compromise in performance or cost. However, some additions might enhance surface target performance, such as an auxiliary shaped charge or explosively-formed penetrator (EFP) warhead for hard points or vehicles, and add-on despin, decelerator modules to permit the use of such warheads and increased seeker footprint.

In projectile-borne or missile-borne rolling submunitions for use against surface targets only, a combination EFP-blast-fragment warhead and a triple divert to contact offer multiple hard kills per carrier and maximum cost-effectiveness. EFP effectiveness can be improved using spin-control deployment by use of a canted EFP or a tripping of the missile itself to bring the EFP warhead to bear on a selected target point at a selected roll or spin position.

CARRIERS

As an alternative to gun launch, the same or a similar soft-launch projectile can be carried as a stage of a missile and spun up and off for identical operation in the final encounter. The same or very similar subsystems can be configured for a slowly-spinning guided missile or bomb. As noted above, several of these projectiles can be bundled in a larger projectile or missile/rocket to achieve higher probability of kill or multiple kills per launch. The busses themselves may have the necessary intelligent circuitry to increase delivery accuracy.

SUB SYSTEMS

SEEKER MODES

Because of the fire control systems, uncorrected ballistic miss distances are expected to be a few hundreds of feet or less, requiring seeker ranges of a few thousands of feet or less. Such a short-range seeker may employ one or more sensing media, such as passive or active radar or optical, and/or semi-active radar or laser fire control radar reflections. The larger the number of channels, the less is the impact of noise, counter-measures, weather, clutter, component failure, etc., but the more is the cost.

INITIALIZER OR DATA LINK

While the projectile has sufficient intelligence to find its own targets and optimize operations against them autonomously, without any external assistance, its performance may be enhanced or simplified by introducing certain fire control information during or just after launch. For example, by introducing expected target search coordinates, search time is saved, permitting longer range acquisition or smaller, cheaper seekers. By inputting expected target range and velocity or measured target range and velocity, more accurate course-correction and fuzing is permitted, and by inputting target type, the fuzing and warhead modes can be optimized. Such information may be inserted into the projectile by ultrasonic, magnetic, electrical or electromagnetic means.

The addition of a data link instead of an initializer provides several advantages. For example, in conjunction with a radar fire control system, a data link permits foul weather operation by using fire control information for one or more diverts, until the $I^2R$ seeker or fuze breaks through. As a last resort, if $I^2R$ fuzing proves impossible in a particular circumstance, less accurate command fuzing may be used. Another advantage of the data link is the bonus of fire control commanded diverts, which may enable earlier diverts, or at least the first and second ones, than the range limited seeker, with more recent information than is available through the initializer at launch, thereby increasing the projectile footprint and reducing the miss distance. This feature is especially helpful and indeed necessary against long-range surface targets.

SUMMARY

It will now be understood that the spin-stabilized guided projectile of the present invention uses roll to its advantage in every subsystem. It uses roll for auto-navigation to provide stable, accurate flight along a minimum-energy ballistic intercept path with lock-on after launch. It uses roll for a powerful imaging-infrared seeker-fuze to generate and stabilize imagery, used in many ways. It uses roll in quick-response explosive diverts by vectoring the just-in-time, short-range, minimum-drag course-corrections. It uses roll to effectively direct the warhead, by using the roll to vector the lethal at-a-distance, focused warhead fragments. By using roll as a prime mover, in lieu of moving parts, the projectile of the present invention can be relatively low-cost and relatively high-reliability.

Having thus described a preferred embodiment of the invention,

What is claimed is:

1. A spin-stabilized ballistic projectile for destroying a selected target; the projectile having a longitudinal axis and comprising:

an imaging array of infrared detectors for scanning images in at least one of a plurality of concentric circular patterns about the projectile axis, said scanning being implemented by the spin of said projectile about said axis; and at least one course-correction explosive device located on said projectile for applying a course correcting impulse through the center of gravity of said projectile in a direction perpendicular to said axis, the precise direction of said impulse being determined by the spin of said projectile and the timing of said impulse relative to said spin;

said imaging array having a wide angle field of view provided by a plurality of detectors configured as a radial array;

said array being configured for tracking said target to intercept based upon a skewed seeker cone using said course-correction explosive device, the skewed cone having a generatrix which is the vector sum of projectile velocity course correction divert velocity and the negative of target velocity.

2. The projectile recited in claim 1 further comprising:

a directional mass-focus warhead selectively projectable from said projectile in at least one selected direction relative to said projectile axis, the precise direction of said warhead being determined by the spin of said projectile and the timing of detonating said warhead relative to said spin.

3. A spin-stabilized ballistic projectile for destroying a selected target; the projectile having a longitudinal axis and comprising:

an imaging array of infrared detectors for scanning images in at least one of a plurality of concentric circular patterns about the projectile axis, said scanning being implemented by the spin of said projectile about said axis; and a directional mass-focus warhead selectively projectable from said projectile in at least one selected direction relative to said projectile axis, the precise direction of said warhead being determined by the spin of said projectile and the timing of detonating said warhead relative to said spin;

said imaging array having a wide angle field of view provided by a plurality of detectors configured as a radial array;

said array being configured for tracking said target to intercept based upon a skewed fuzing cone and for selectively projecting said directional mass-focus warhead at a vulnerable area of said target, the skewed cone having a generatrix which is the vector sum of projectile velocity warhead velocity and the negative of target velocity.

4. The projectile recited in claim 1 further comprising:

a forward projecting terminal warhead selectively projectable from said projectile, the precise direction of said warhead being dependent upon the spin of said projectile and the timing of detonation of said warhead.

5. A spin-stabilized ballistic projectile for destroying a selected target; the projectile having a longitudinal axis and comprising:

an imaging array of infrared detectors for scanning images in at least one of a plurality of concentric circular patterns about the projectile axis, said scanning being implemented by the spin of said projectile about said axis; and a planar warhead selectively projectable from said projectile;

said imaging array having a wide angle field of view provided by a plurality of detectors configured as a radial array;

said array being configured for tracking said target to intercept based upon a skewed fuzing cone and for selectively projecting said directional mass-focus warhead at a vulnerable area of said target, the skewed cone having a generatrix which is the vector sum of projectile velocity, warhead velocity and the negative of target velocity.

6. The spin-stabilized ballistic projectile recited in claim 5 and further comprising:

at least one course-correction explosive device located on said projectile for applying a course correcting impulse through the center of gravity of said projectile in a direction perpendicular to said axis, the precise direction of aid impulse being determined by the spin of said projectile and the timing of said impulse relative to said spin.

* * * * *